US007014473B2

(12) United States Patent
Millard et al.

(10) Patent No.: US 7,014,473 B2
(45) Date of Patent: Mar. 21, 2006

(54) SPIRALED ELECTRICAL CONTACT

(75) Inventors: Steven Jay Millard, Mechanicsburg, PA (US); Darrel Lynn Wertz, York, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/865,048

(22) Filed: Jun. 10, 2004

(65) Prior Publication Data

US 2005/0277306 A1 Dec. 15, 2005

(51) Int. Cl.
*H01R 12/00* (2006.01)

(52) U.S. Cl. ..... 439/66

(58) Field of Classification Search ..... 439/66
See application file for complete search history.

(56) References Cited

U.S. PATENT DOCUMENTS 4,961,709 A 10/1990 Noschese ..... 439/66
5,167,512 A * 12/1992 Walkup ..... 439/66
6,843,658 B1 * 1/2005 Kuwabara et al. ..... 439/66

* cited by examiner

*Primary Examiner*—Truc Nguyen

(57) ABSTRACT

An electrical contact includes a conductor spirally wrapped about itself from a longitudinal edge. The spirally wrapped conductor defines a longitudinal axis through the contact. The spirally wrapped conductor includes a center spiraled section between first and second contact ends, and the spirally wrapped conductor is compressible along the longitudinal axis.

7 Claims, 5 Drawing Sheets

SPIRALED ELECTRICAL CONTACT

BACKGROUND OF THE INVENTION

The invention relates generally to electrical contacts and, more particularly, to a wrapped electrical contact for a socket connector.

Competition and market demands have continued the trends toward faster, higher performance electrical systems, particularly with regard to computer systems. Along with the development of surface mount technology in the design of printed circuit boards, higher density electrical circuits, including higher density interconnect components have been developed to meet the increasing demand for higher performance electrical systems.

As is well understood in the art, surface mountable packaging allows for the connection of the package to pads on the surface of the circuit board rather than by contacts or pins soldered in plated holes going through the circuit board. As used herein, the term "package" shall refer to a chip carrying module that is to be mounted to a circuit board. Surface mount technology allows for an increased component density on a circuit board, thereby saving space on the circuit board.

Area array socket connectors have evolved, along with surface mount technology, as one high density interconnect methodology. One significant application of this technology, for example, is the land grid array (LGA) socket connector that is used with an LGA package. One major advantage of the LGA package lies in its durability. The LGA package is not easily damaged during the installation or removal process or by handling generally. At least some of the other integrated circuit (IC) packages, such as a pin grid array (PGA) package, have a standardized layout, or form factor, for contact leads or pins on the package. These contact leads are somewhat fragile and can be damaged if not handled properly. By contrast, with an LGA package, there is nothing protruding from the package that can be bent or otherwise damaged during normal handling.

While the LGA package is quite durable, the LGA socket is somewhat less so. In the LGA socket, the contacts are partially exposed. To minimize the possibility of damage to the contacts, the LGA socket is designed for loading and unloading of the package in a vertical direction, e.g. normal to the circuit board.

One potential problem with the LGA form factor lies in the fact that ceramic surfaces on electronic packages are not perfectly flat. In the case of an LGA package, the ceramic surfaces of the mating face is also not perfectly flat, so that the LGA socket must provide enough compliance in the loading direction to provide tolerance for the unevenness of the package surface. Package manufacturers, naturally, would like this tolerance to be as great as possible, while socket manufacturers would like to keep it small.

In the typical LGA socket, the contacts have flexible cantilevered beams that mate with the LGA package. These beams are deflected as the socket moves through its compliance range to accommodate surface variations in the LGA package. Additionally, any unevenness in the circuit board mounting surface is also dealt with through the compliance of the socket and the flexibility of the contacts. As the contact beams are deflected however, they overlay each other which can result in electrical coupling between the contacts which introduces noise into the system.

A need exists for contacts that can accommodate the compliance of the LGA socket without introducing noise into electronic systems.

BRIEF DESCRIPTION OF THE INVENTION

In one aspect, an electrical contact is provided. The contact includes a conductor spirally wrapped about itself from a longitudinal edge. The spirally wrapped conductor defines a longitudinal axis therethrough. The spirally wrapped conductor includes a center spiraled section between first and second contact ends, and the spirally wrapped conductor is compressible along the longitudinal axis.

Optionally, the conductor includes a contact body having a first end and an opposite second end, and first and second contact beams extending from opposite sides of the first end of the contact body at an obtuse angle. The contact body defines the center section of the spirally wrapped conductor. Each contact beam includes a distal end with respect to the contact body first end. The first and second contact ends of the spirally wrapped conductor extend from a respective one of the distal ends of the contact beams. Each contact beam can include a slot that increases a flexibility of the spirally wrapped conductor along the longitudinal axis.

In another aspect, an electrical contact for a Land Grid Array (LGA) socket connector is provided. The contact includes a conductor spirally wrapped about itself from a longitudinal edge, the spirally wrapped conductor defining a longitudinal axis therethrough. The spirally wrapped conductor includes a center spiraled section between first and second contact ends. The spirally wrapped conductor has a decreasing diameter from the center section to each of the first and second contact ends. The spirally wrapped conductor is compressible along the longitudinal axis so that a spacing between adjacent contact ends when a module is not present in the socket is substantially maintained when the module is loaded in the socket.

In another aspect, an electrical connector is provided that includes a socket housing having an array of contact apertures and a plurality of electrical contacts located in a respective one of the contact apertures. Each contact includes a conductor spirally wrapped about itself from a longitudinal edge. The spirally wrapped conductor defines a longitudinal axis therethrough and includes a center spiraled section between first and second contact ends. The center section engages a wall of the aperture to frictionally retain the spirally wrapped conductor within the aperture. The spirally wrapped conductor is compressible along the longitudinal axis.

DETAILED DESCRIPTION OF THE INVENTION

Figure 1:
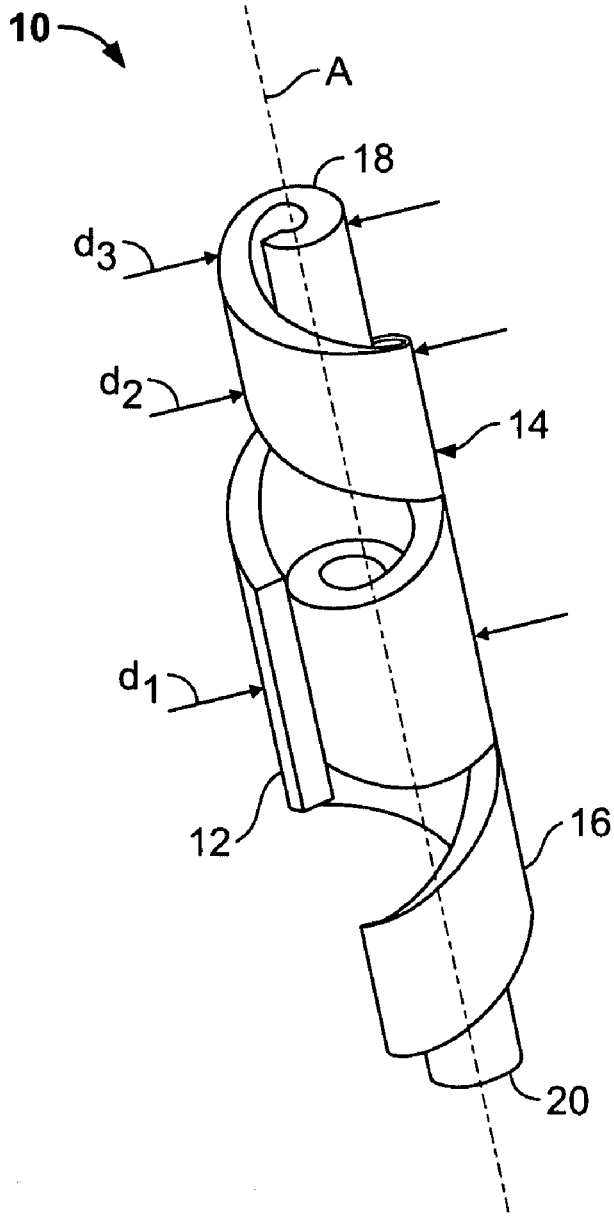
FIG. 1 is a perspective view of an exemplary electrical contact formed in accordance with an exemplary embodiment of the present invention.

FIG. 1 illustrates a perspective view of an electrical contact 10 formed in accordance with an exemplary embodiment of the present invention. The contact 10 is a wrapped spring contact adapted for use in an array socket connector such as a land grid array (LGA) connector. It is appreciated, however, that the benefits and advantages of the invention may accrue equally to other types of connectors and sockets across a variety of circuit board connector applications. Therefore, while the invention is described and illustrated in the context of an LGA connector contact 10, the invention is not intended to be limited to such an application, and the description below is therefore provided for purposes of illustration rather than limitation.

The wrapped spring contact 10 is wrapped into a helical or spiral shape having a longitudinal axis A. The contact 10 includes a center section 12 between first and second wrapped contact beams 14 and 16 respectively. The first contact beam 14 culminates in a contact end 18 while the second contact beam 16 culminates in a contact end 20. In an exemplary embodiment, the spirally wrapped contact 10 has a decreasing outer diameter from the center section 12 to each of the contact ends 18 and 20. That is, the center section 12 has an outer diameter $d_1$ that is larger than the contact beam outer diameter $d_2$ that is larger than the contact end outer diameter $d_3$. The wrapped spring contact 10 is compressible along the longitudinal axis A.

Figure 2:
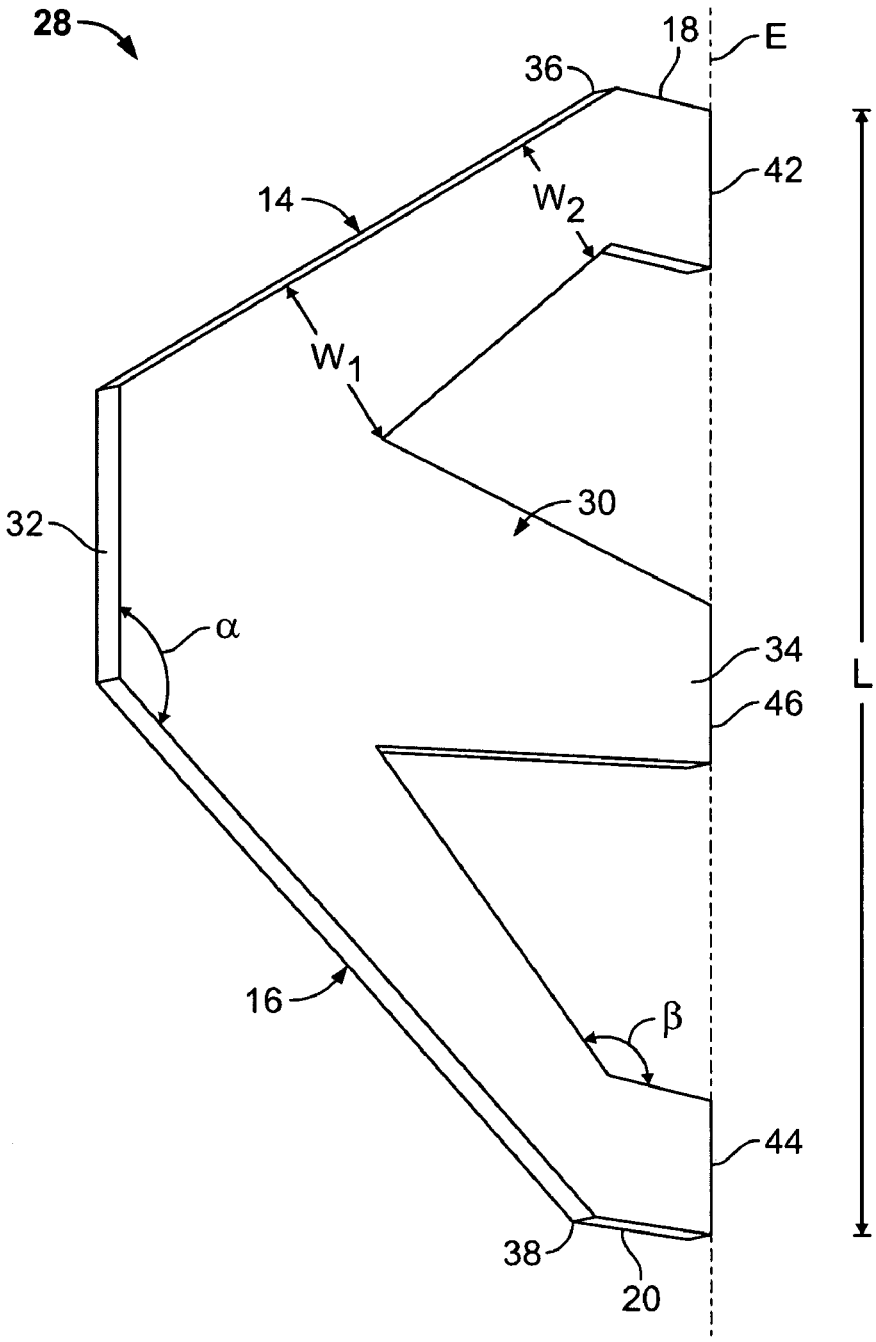
FIG. 2 is a perspective view of the contact shown in FIG. 1 at a first stage of manufacture.

FIG. 2 illustrates a perspective view of the wrapped spring contact 10 at a first stage of manufacture. As shown in FIG. 2, the contact 10 is in the form of a flat blank of conductive material 28 having a longitudinal edge E. The blank 28 includes a contact body 30 that has a first end 32 and an opposite second end 34. First and second contact beams 14 and 16 extend from opposite sides of the first end 32 of the contact body 30 at an obtuse angle $\alpha$. Each contact beam 14 and 16 has a distal end 36 and 38 respectively with respect to the first end 32 of the contact body 30. Each contact beam 14 and 16 exhibits a taper from a first width $W_1$ proximate the first end 32 of the contact body 30 to a narrower second width $W_2$ at the distal ends 36 and 38. The contact end 18 extends from the distal end 36 of the contact beam 14. The contact end 20 extends from the distal end 38 of the contact beam 16. The contacts ends 18 and 20 also extend from the contact beam distal ends 36 and 38 respectively at a second obtuse angle $\beta$. The contact end 18 includes an end edge 42, and the contact end 20 includes an end edge 44. In some embodiments, including the embodiment shown in FIG. 2, the end edges 42 and 44 align with an edge 46 of the contact body second end 34 and are coextensive with the longitudinal edge E. In other embodiments, however, the end edges 42 and 44 do not align with the edge 46 of the contact body second end 34 or the longitudinal edge E. The blank 28 also has a length L extending between the contact ends 18 and 20.

The wrapped spring contact 10 is formed by rolling or winding the contact blank 28 about its longitudinal edge E so that the blank 28 is wrapped about itself. The wrapped spring contact 10 has an overall length corresponding to the length L of the blank 28 and defines the longitudinal axis A therethrough. The angled contact beams 14 and 16 impart the spiral shape to the wrapped contact 10 as shown in FIG. 1. The contact body 30 defines the center section 12 of the wrapped spring contact 10. The second end 34 of the contact body 30 is wrapped interiorly with respect to the first end 32 of the contact body 30 when the contact blank 28 is wrapped to form the wrapped spring contact 10. When wrapped, the contact 10 is resiliently flexible or compressible along the longitudinal axis A.

Figure 3:
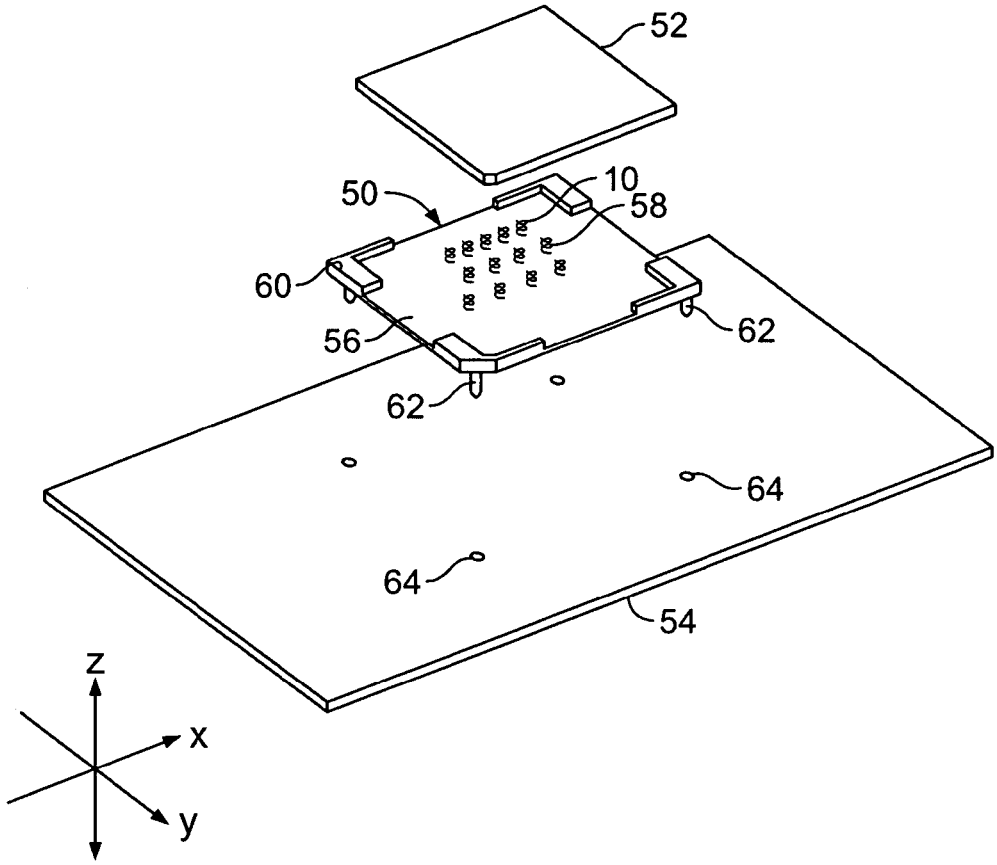
FIG. 3 is an exploded view of an electronic module, a socket and a circuit board in accordance with an exemplary embodiment of the invention.

FIG. 3 illustrates a perspective view of an exemplary socket 50 with which the wrapped spring contact 10 may be used. The socket 50 is an LGA socket that receives an LGA package 52 for use with a circuit board 54. The socket 50 includes a cover (not shown) and an insulative socket housing 56 that includes a plurality of contact apertures 58. The wrapped spring contacts 10 are loaded into respective contact apertures 58 in the socket 50. When loaded into the socket housing 56, the center section 12 of the wrapped spring contact 10 engages the side walls of the contact apertures 58 in the socket housing 56 with a friction fit, thereby retaining the wrapped spring contact 10 in the socket housing 56. Since the wrapped spring contact 10 is held in the socket by the center section 12, which has the largest outer diameter $d_1$, the contact ends 18 and 20 are free to deflect along the longitudinal axis A (see FIG. 1) without rubbing against the dielectric material of the socket housing 56.

Unlike the zero insertion force applications commonly used with a pin grid array (PGA) form factor, LGA applications typically employ a compressive load to insure proper mating of the connector contacts with the circuit board 54 and with the LGA package 52. The wrapped spring contact 10 is suitable for use in highly compliant sockets that allow considerable movement in the package loading direction or Z axis, which in an exemplary socket may be as much as sixteen mills, to allow for unevenness in the surface of both the LGA package 52 and the circuit board 54.

The compliance of the socket 50 requires an equally compliant electrical contact such as the wrapped spring contact 10 in order to couple the LGA package 52 to the circuit board 54. Unlike the known cantilevered beam contacts wherein the contact ends overlay each other and are moved closer to one another during package loading, the wrapped spring contact 10 is compressible along its longitudinal axis A so that a spacing between adjacent contact ends when the LGA package 52 is not loaded in the socket 50 is maintained when the LGA package 52 is loaded onto the socket 50. This minimizes electrical coupling between adjacent contacts and reduces noise.

The wrapped spring contact 10 extends through the socket housing 56 with one contact end 18, 20 in contact with the circuit board 54 and the other contact end 18, 20 in contact with the LGA package 52. The components are held together through the application of a compressive load. In one embodiment, the socket housing 56 is provided with locator pads 60 to position the LGA package 52 on the socket housing 56. Locating pins 62 align the socket 50 with locating holes 64 in the circuit board 54. The locator pads 60 and locating pins 62 cooperate to provide a locating feature to orient the LGA package 52 for registration with the circuit board 54. It is to be understood however, that various other locating systems are well known and may be used.

Figure 4:
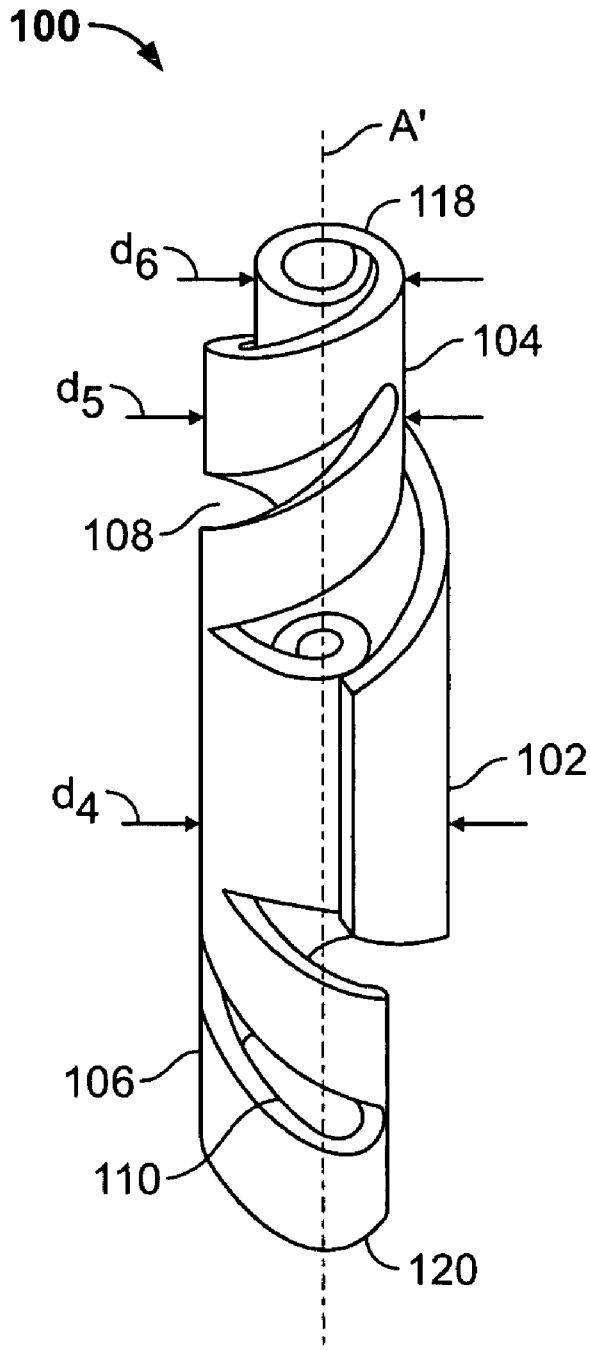
FIG. 4 is a perspective view of an electrical contact formed in accordance with another embodiment of the present invention.

FIG. 4 is a perspective view of an electrical contact 100 formed in accordance with an alternative embodiment of the present invention. The wrapped spring contact 100 is also in the form of a conductor formed into a spiral shape. The wrapped spring contact 100 has a longitudinal axis A'. The contact 10 includes a center section 102 between first and second wrapped contact beams 104 and 106 respectively. The contact beam 104 includes a slot 108 and the contact beam 106 includes a slot 110. The slots 108 and 110 in the contact beams 104 and 106 are provided to vary the spring characteristics of the wrapped spring contact 100. The first contact beam 104 culminates in a contact end 118 while the second contact beam 106 culminates in a contact end 120. In an exemplary embodiment, the spirally wrapped contact 100 has a decreasing outer diameter from the center section 102 to each of the contact ends 118 and 120. That is, the center section 12 has an outer diameter $d_4$ that is larger than the contact beam outer diameter $d_5$ that is larger than the contact end outer diameter $d_6$. The wrapped spring contact 100 is compressible along the longitudinal axis A'.

Figure 5:
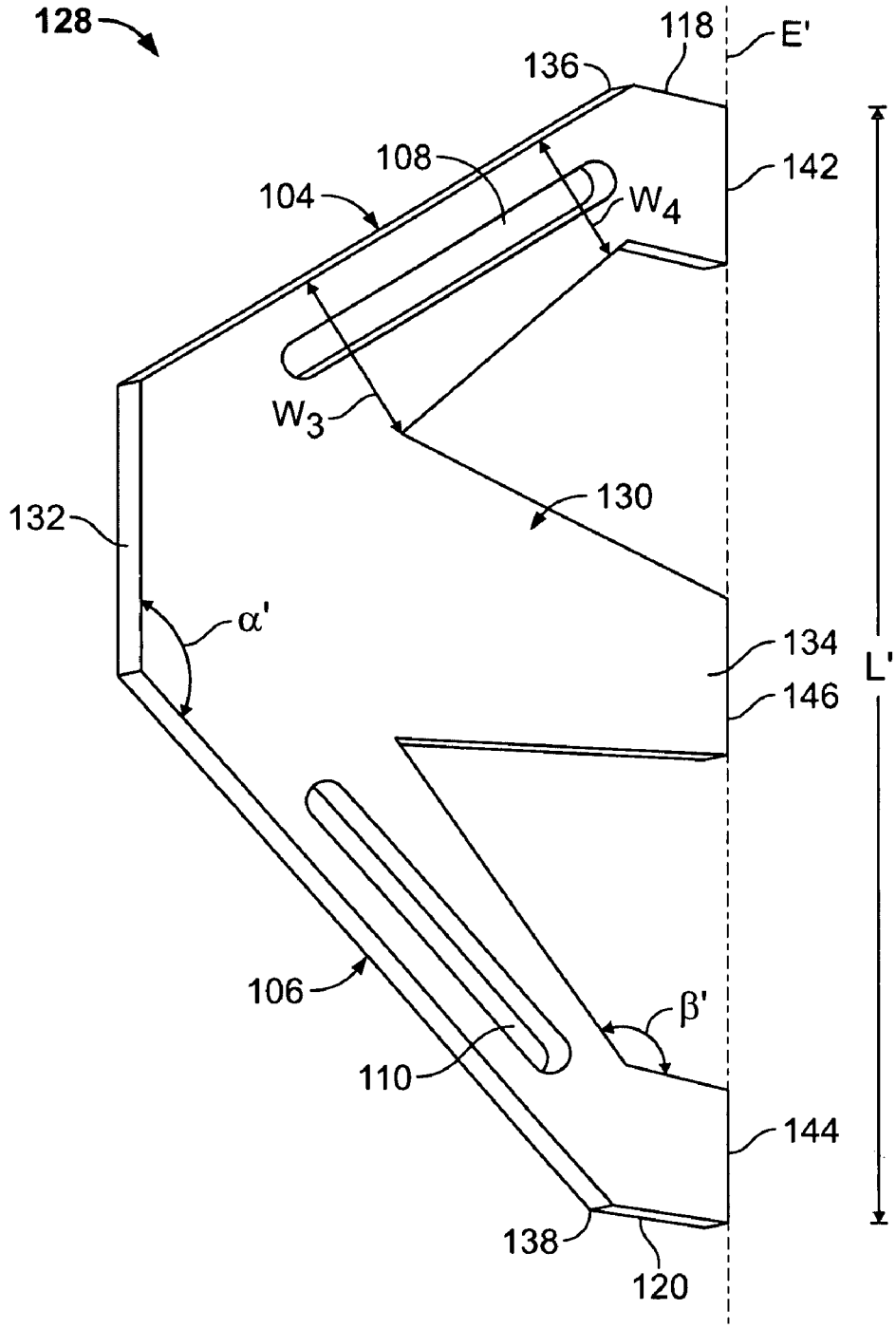
FIG. 5 is a perspective view of the contact shown in FIG. 4 at a first stage of manufacture.

FIG. 5 illustrates a perspective view of the wrapped spring contact 100 at a first stage of manufacture. As shown in FIG. 5, the contact 100 is in the form of a flat blank of conductive material 128 having a longitudinal edge E'. The blank 128 includes a contact body 130 that has a first end 132 and an opposite second end 134. First and second contact beams 104 and 106 extend from opposite sides of the first end 132 of the contact body 130 at an obtuse angle α'. Each contact beam 104 and 106 has a distal end 136 and 138 respectively with respect to the first end 132 of the contact body 130. Each contact beam 104 and 106 exhibits a taper from a first width $W_3$ proximate the first end 132 of the contact body 130 to a narrower second width $W_4$ at the distal ends 136 and 138. The contact end 118 extends from the distal end 136 of the contact beam 104. The contact end 120 extends from the distal end 138 of the contact beam 106. The contacts ends 118 and 120 also extend from the contact beam distal ends 136 and 138 respectively at a second obtuse angle β'. The contact end 118 includes an end edge 142, and the contact end 120 includes an end edge 144. In some embodiments, including the embodiment shown in FIG. 5, the end edges 142 and 144 align with an edge 146 of the contact body second end 134 and are coextensive with the longitudinal edge E'. In other embodiments, however, the end edges 142 and 144 do not align with the edge 146 of the contact body second end 134 or the longitudinal edge E'. The blank 128 also has a length L' extending between the contact ends 118 and 120.

As with the contact 10 previously described, the wrapped spring contact 100 is formed by rolling or winding the contact blank 128 about its longitudinal edge E' so that the contact blank 128 is wrapped about itself. The wrapped spring contact 100 has an overall length corresponding to the length L' of the blank 128 and defines the longitudinal axis A' therethrough. The angled contact beams 104 and 106 impart the spiral shape to the wrapped contact 100. The contact body 130 defines the center section 102 of the wrapped spring contact 100. The second end 134 of the contact body 130 is wrapped interiorly with respect to the first end 132 of the contact body 130 when the contact blank 128 is wrapped to form the wrapped spring contact 100. When wrapped, the contact 100 is resiliently flexible or compressible along the longitudinal axis A'.

The embodiments thus described provide a wrapped spring contact 10, 100 that is suitable for use in a compliant socket such as an LGA socket 50. The wrapped spring contact 10, 100 is compressible along a longitudinal axis A, such that a contact spacing is maintained between adjacent contact ends when a package 52 is loaded onto the socket 50, which minimizes electrical coupling between the contacts and reduces noise. Angled contact beams 14, 16 impart a spiral shape to the wrapped spring contact 10, 100. The contact beams 104, 106 can be provided with slots 108, 110 to vary the spring characteristics of the wrapped spring contact 10, 100.

While the invention has been described in terms of various specific embodiments, those skilled in the art will recognize that the invention can be practiced with modification within the spirit and scope of the claims.

What is claimed is:

1. An electrical contact comprising:

a conductor spirally wrapped about itself from a longitudinal edge thereof, said spirally wrapped conductor defining a longitudinal axis therethrough, said spirally wrapped conductor including a center spiral section between first and second contact ends, said spirally wrapped conductor being compressible along said longitudinal axis, wherein said conductor comprises a contact body having a first end and an opposite second end, and first and second contact beams extending from opposite sides of said first end of said contact body at an obtuse angle, each said contact beam including a slot therein, said slots influencing a flexibility of said spirally wrapped conductor along said longitudinal axis.

2. The contact of claim 1, wherein said second end of said contact body is wrapped interiorly with respect to said first end of said contact body when said conductor is spirally wrapped.

3. An electrical contact comprising:

a conductor spirally wrapped about itself from a longitudinal edge thereof, said spirally wrapped conductor defining a longitudinal axis therethrough, said spirally wrapped conductor including a center spiral section between first and second contact ends, said spirally wrapped conductor being compressible along said longitudinal axis, wherein said conductor comprises a contact body having a first end and an opposite second end, and first and second contact beams extending from opposite sides of said first end of said contact body at an obtuse angle, each said contact beam including a distal end with respect to said contact body first end, each said contact beam narrowing in width from said first end of said contact body to said distal end.

4. The contact of claim 3, wherein said second end of said contact body is wrapped interiorly with respect to said first end of said contact body when said conductor is spirally wrapped.

5. An electrical connector comprising:

a socket housing including an array of contact apertures; and a plurality of electrical contacts each located in a respective one of said contact apertures, each said contact comprising a conductor spirally wrapped about itself from a longitudinal edge thereof, said spirally wrapped conductor defining a longitudinal axis therethrough, said spirally wrapped conductor including a center spiraled section between first and second contact ends, said center section engaging a wall of said aperture to frictionally retain said spirally wrapped conductor within said aperture, said spirally wrapped conductor being compressible along said longitudinal axis, wherein said conductor comprises a contact body having a first end and an opposite second end, and first and second contact beams extending from opposite sides of said first end of said contact body at an obtuse angle, each said contact beam including a distal end with respect to said contact body first end, each said contact beam narrowing in width from said first end of said contact body to said distal end.

6. The connector of claim 5, wherein said socket housing further includes a locating feature to orient an electronic module on said socket housing for registration with a circuit board.

7. The connector of claim 5, wherein each said contact beam includes a slot therein to increase a flexibility of said spirally wrapped conductor along said longitudinal axis.

* * * * *